United States Patent [19]

Hodges, deceased

[11] 4,162,015

[45] Jul. 24, 1979

[54] DISPLAY FOR FISHING RODS

[75] Inventor: Bill J. Hodges, deceased, late of Atoka, Okla., by Bernice G. Hodges, executrix

[73] Assignee: Lawrence Peska Associates, Inc., New York, N.Y. ; a part interest

[21] Appl. No.: 808,827

[22] Filed: Jun. 22, 1977

[51] Int. Cl.[2] ..... A47F 5/00

[52] U.S. Cl. ..... 211/87; 211/59.1; 211/60 R; 211/125; 248/221.2

[58] Field of Search ..... 211/87, 105.1, 54, 57, 211/59, 60, 61, 62, 65, 66, 67, 68, 125; 248/220.4, 221.1, 221.2, 309 A

[56] References Cited

U.S. PATENT DOCUMENTS

| | | | |
|---|---|---|---|
| 502,843 | 8/1893 | Addison | 211/65 |
| 988,468 | 4/1911 | Harth | 211/125 |
| 990,711 | 4/1911 | Cuddy | 211/125 |
| 1,543,501 | 6/1925 | Hiatt | 211/65 |
| 3,897,926 | 8/1975 | Silver | 248/221.2 |
| 4,025,018 | 5/1977 | Thalenfeld | 211/59.1 X |

*Primary Examiner*—Roy D. Frazier
*Assistant Examiner*—Terrell P. Lewis

[57] ABSTRACT

A display for fishing rods, the display comprising a wall mounting member, a rigid base member extending outwardly from and substantially normal to the wall mounting member, and first and second rows of thin elongated projections extending outwardly and upwardly from the base member, the projections being adapted to receive a fishing line guide ring portion of a fishing rod.

2 Claims, 3 Drawing Figures

DISPLAY FOR FISHING RODS

BACKGROUND OF THE INVENTION

1. Field of the Invention

This invention relates to display devices and is directed more particularly to a display for fishing rods.

2. Description of the Prior Art

It is common place today for fishing rods to be displayed in cases having a receptacle for the handle portions of the rods and a receptacle or notch for receiving some portion of the pole section of the rod. The rods are normally displayed side-by-side and require a substantial amount of wall and/or floor space for the presentation of a significant number of styles and sizes of rods.

SUMMARY OF THE INVENTION

An object of the present invention is to provide a fishing rod display device which permits the display of a large number of rods in a minimum amount of space.

Another object of the invention is to provide such a display permitting ready removal and replacement of rods for the perusal of perspective rod buyers.

A still further object of the invention is to provide such a device which is economical to manufacture, easy to install, and easy to use by both store proprietors and their customers.

With the above and other objects in view, as will hereinafter appear, a feature of the present invention is the provision of a display for fishing rods, the display comprising a wall mounting member having means therein for connection to a wall or other upstanding structure, a rigid base member extending outwardly from and substantially normal to the mounting member, a first row of thin elongated projections extending outwardly and upwardly from the base member, and a second row of thin elongated projections extending outwardly and upwardly from the base member, the first and second rows of projections extending from opposite sides of the base member and extending in directions away from each other.

The above and other features of the invention, including various novel details of construction in combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

DESCRIPTION OF THE PREFERRED EMBODIMENT

Figure 1:
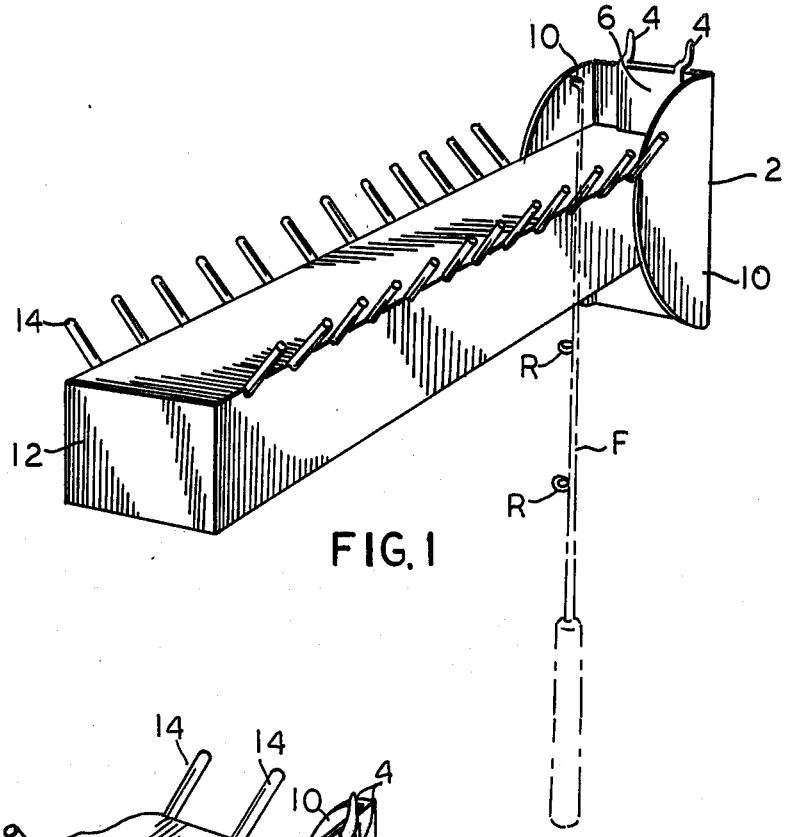
FIG. 1 is a perspective view of one form of display illustrative of an embodiment of the invention.
Figure 2:
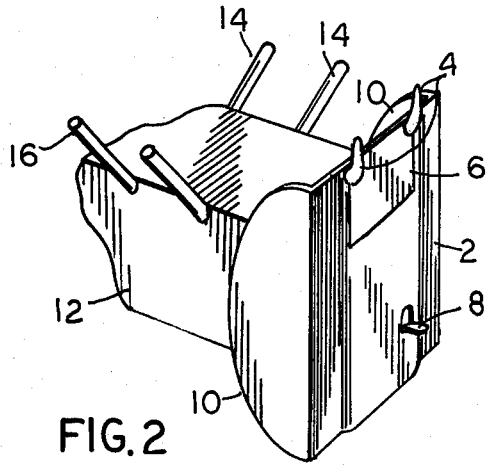
FIG. 2 is a perspective view of a portion of the display shown in FIG. 1.
Figure 3:
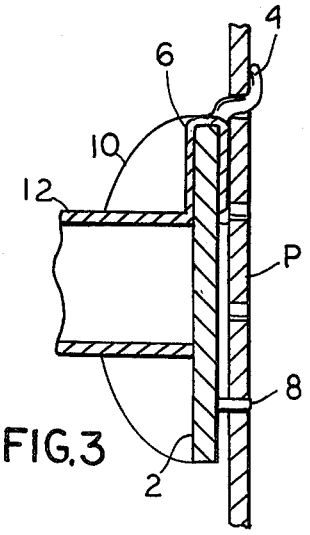
FIG. 3 is a sectional view of a portion of the device shown in FIG. 1.

Referring to FIG. 1, it will be seen that the illustrative device includes a mounting member 2 suitable for connection to a wall or other upstanding structure. The mounting member 2 is preferably provided with support hook means 4. The support hook means 4 may be two or more hooks directed generally upwardly, backwardly, and again upwardly, as is best seen in FIG. 3. The hooks 4 may be connected at their bases to a clamp 6 which is secured to the upper edge of the mounting member 2 or may, if desired, extend directly from or as an integral part of the mounting member. The mounting member 2 is further provided with a stabilizing hook 8 suitable for insertion in an aperture of a pegboard P and, in cooperation with the hooks 4, providing a stable mounting for the mounting member 2 on such pegboard. The mounting member may, if desired, be provided with forwardly extending wing portions 10 on either side thereof.

Secured to the mounting member 2 and extending outwardly therefrom and substantially normal thereto is a rigid base member 12. The length of the base member may be selected as appropriate for a particular usage, but is most useful and stable in lengths of from 12 to 18 inches or thereabouts. The base member 12 is preferably of a light metal or rigid plastic, but may be of any rigid material. Preferably, the base member is of hollow box-like construction, as shown in the drawings, providing the required rigidity and lightness.

From one of the upper corners of the base member 12 there is positioned a first row of thin elongated projections 14 adapted to slidingly receive a fishing line guide ring R of a fishing rod F. The base member 12 is in like manner provided with a second row of thin elongated projections 16 extending outwardly and upwardly opposite from the projections 14 and providing further means for receiving fishing rods.

In use, the device is mounted by way of hooks 4 and 8 onto a pegboard or like structure. Fishing rods are hung upon the projections 14, 16 by slipping the guide rings R of the fishing rods F over particular projections. The width of the base member 12, preferably about 2 inches or thereabouts, provides for separation of the first row of fishing rods from the second row of fishing rods, to avoid entanglement of one rod with another. Preferably, the projections 14, 16 are coated with a soft rubber layer to minimize scratching of the fishing rod guide rings.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. A display for fishing rods, said display comprising a mounting member, a plurality of support hook means extending upwardly from said mounting member rearwardly thereof and again upwardly to facilitate engagement with a pegboard, stabilizing hook means extending from said mounting member and adapted to engage said pegboard, a rigid base member extending outwardly from and substantially normal to said mounting member, said mounting member being provided with wing portions estending forwardly, one wing portion disposed on either side of said base member, said wing portions being in contact with said base member sustantially the entire forwardly extending length of said wing portion, said base member comprising an elongated hollow box-like member, the sides of said box-like member being substantially parallel to the force of gravity, a first row of thin elongated projections extending outwardly and upwardly from a first upper corner of said box-like member, and a second row of thin elongated projections extending outwardly and upwardly from a second upper corner of said box-like member, said projections being adapted to slidingly receive a fishing line guide ring of a fishing rod, said first and second rows of projections extending from opposite sides of said base member and extending in directions away from each other.

2. The invention according to claim 1 in which said projections are coated with a soft rubber material.

* * * * *